US006426119B1

(12) United States Patent
Yapel et al.

(10) Patent No.: US 6,426,119 B1
(45) Date of Patent: Jul. 30, 2002

(54) COATING METHOD EMPLOYING DIE ENCLOSURE SYSTEM

(75) Inventors: Robert A. Yapel, Oakdale; Kent D. Nelson, Afton; Thomas M. Milbourn, Mahtomedi; Richard J. Foss, Pine City, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/657,499

(22) Filed: Sep. 8, 2000

Related U.S. Application Data

(62) Division of application No. 08/177,288, filed on Jan. 4, 1994, now Pat. No. 6,117,237.

(51) Int. Cl.[7] ..... B05D 1/26

(52) U.S. Cl. ..... 427/335; 427/356; 427/358; 427/359; 427/402; 427/420; 427/428; 118/65; 118/203; 118/244; 118/410; 118/DIG. 4

(58) Field of Search ..... 118/DIG. 4, 410, 118/411, 65, 203, 244, 249, 258, 262, DIG. 7; 427/420, 402, 358, 356, 428, 359, 335

(56) References Cited

U.S. PATENT DOCUMENTS

| | | | | |
|---|---|---|---|---|
| 2,815,307 A | * | 12/1957 | Beck | 154/102 |
| 3,518,964 A | | 7/1970 | Nagler | |
| 3,635,192 A | | 1/1972 | Herzhoff et al. | |
| 3,690,297 A | | 9/1972 | Dentch et al. | |
| 4,292,349 A | | 9/1981 | Ishiwata et al. | |
| 4,331,713 A | | 5/1982 | Girard et al. | |
| 4,452,833 A | | 6/1984 | Holt | |
| 4,643,127 A | | 2/1987 | Wanke | |
| 4,679,524 A | | 7/1987 | Eklund | |
| 4,728,539 A | | 3/1988 | Gane | |
| 4,793,899 A | | 12/1988 | Skaugen | |
| 4,835,021 A | | 5/1989 | Fronheiser | |
| 4,858,533 A | | 8/1989 | Warren | |
| 4,880,671 A | | 11/1989 | Sollinger et al. | |
| 4,911,097 A | | 3/1990 | Fundell | |
| 4,963,397 A | | 10/1990 | Mayer et al. | |
| 5,076,200 A | | 12/1991 | Mayer et al. | |
| 5,112,653 A | | 5/1992 | Damrau et al. | |
| 5,114,759 A | * | 5/1992 | Finnicum et al. | 427/420 |
| 5,136,972 A | | 8/1992 | Naka et al. | |
| 6,117,237 A | | 9/2000 | Yapel et al. | |

FOREIGN PATENT DOCUMENTS

| | | | |
|---|---|---|---|
| DE | 43 16 402 A1 | | 11/1994 |
| DE | 43 160 402 A1 | * | 11/1994 |
| JP | 62-121669 | * | 6/1987 |
| JP | 63-116851 | * | 5/1988 |
| WO | WO 90/01178 | | 2/1990 |

OTHER PUBLICATIONS

Research Disclosure, Feb. 1992, pp. 111–117, No. 33427, "Manufacturing of Solvent–based image–forming materials".

* cited by examiner

*Primary Examiner*—Katherine A. Bareford
(74) *Attorney, Agent, or Firm*—Brian E. Szymanski

(57) ABSTRACT

The coater apparatus enclosure encloses the entire die of a coating apparatus includes an enclosure structure, a saturation station which saturates a supply gas with solvent, a device which supplies solvent-saturated gas to the enclosure to continuously purge the enclosure, and a device which controls the gas flow to the enclosure. The saturation station could include a heated jacketed vessel and a porous metal bubbler, or it could include a series of heat exchangers. No streaks can form due to coating fluid drying on the die lip because the gas supplied to the die enclosure is saturated with the solvent.

6 Claims, 3 Drawing Sheets

COATING METHOD EMPLOYING DIE ENCLOSURE SYSTEM

This is a divisional of application Ser. No. 08/177,288 filed Jan. 4, 1994, now U.S. Pat. No. 6,117,237.

TECHNICAL FIELD

The present invention relates to coating. More particularly, the present invention relates to die coating.

BACKGROUND OF THE INVENTION

Coating is the process of replacing the gas contacting a substrate, usually a solid surface such as a web, by a layer of fluid. Sometimes, multiple layers of a coating are applied on top of each other. After the deposition of a coating, it can remain a fluid such as in the application of lubricating oil to metal in metal coil processing or the application of chemical reactants to activate or chemically transform a substrate surface. Alternatively, the coating can be dried if it contains a volatile fluid to leave behind a solid coat such as a paint, or can be cured or in some other way solidified to a functional coating such as a release coating to which a pressure sensitive adhesive will not aggressively stick. Methods of applying coatings are discussed in Cohen, E. D. and Gutoff, E. B., *Modern Coating and Drying Technology*, VCH Publishers, New York 1992 and Satas, D., *Web Processing and Converting Technology and Equipment*, Van Vorstrand Reinhold Publishing Co., New York 1984.

Die coating methods include extrusion coating, slide coating, and curtain coating. In die coating, the web to be coated is usually supported by a precision back-up roll. Coating streaks are a problem in any die coating system. A coating streak is a line of material that is uncoated or has a coating thickness less than the average coating thickness within a coating. A coating streak is caused by something blocking or disturbing the flow of fluid in the coating bead which spans the gap between the coater die and the web. Streaking is a major cause of waste in many coater lines. There are three major bead disturbances in the coating bead exiting from the die which cause streaking.

Nicks or dents in the die and dirt particles from the coater area are two disturbances that alter the bead. Dirt particles could be carried by the web and lodge in the gap between the web and coater die, and dirt in the fluid might get lodged in the die and disturb the flow.

The third bead disturbance is caused when the coating fluid dries on the lip and in the feed slot of the coater die, disrupting the precision geometry of the die and thus disturbing the fluid flow. Fluid drying is particularly prevalent when coating fluids with high volatility solvents such as tetrahydrofuran and methyl ethyl ketone are used. Also, drying is more prone to occur when the coating is intermittent or interrupted, such as where separate patches are coated on a web or where discrete piece parts are coated such as by pulsing.

Typically, die coaters do not include any system for controlling the drying of coating fluid on the die lips. U.S. Pat. No. 4,292,349 describes a shield to cover a coating die which collects the solvent evaporating from the fluid itself as it is coated. Eventually, the solvent concentration builds up enough to suppress drying and thus streaks. This patent describes a passive means of suppressing the drying using shields to collect the solvent as it dries from the coating. This method can retard the drying on the coater lips but cannot eliminate it. Additionally, this method only prevents the drying of fluid of the top (downstream) lip of the coater and does nothing to retard drying on the bottom (upstream) lip of the coater.

PCT International Publication No. WO 90/01178 describes a shield for a cascade coater (slide or curtain) to prevent disturbances to the fluid as it flows down the slide.

SUMMARY OF THE INVENTION

The coater apparatus enclosure for enclosing the entire coating applicator portion of a coating apparatus of the present invention overcomes many of the disadvantages of known moisturizing systems. The enclosure can be used when the coating is intermittent, such as where separate patches are coated on a web or where discrete piece parts are coated such as by pulsing.

The enclosure includes an enclosure structure, a saturation station which saturates a supply gas with solvent, and a device which supplies solvent-saturated gas to the enclosure to continuously purge the enclosure.

The enclosure could also include a device which controls the gas flow to the enclosure. The coating applicator portion can be a die and the solvent-saturated gas is continuously pumped at a regulated pressure, in an adequate volume, and at a low rate to maintain solvent saturation in the vicinity of the bead, to maintain a constant positive flow out of the enclosure, and to ensure that the atmosphere in the vicinity of the coater bead is always saturated with solvent. The gas is inert and non-reactive and includes a cosolvent mix in equilibrium with the coating fluid. No drying of the coating fluid is possible and no streaks can form due to coating fluid drying on the die lip because the gas supplied to the die enclosure is already saturated with the solvent.

In one embodiment, the saturation station includes a jacketed vessel containing the liquid solvent, a porous metal bubbler, and a tube through which solvent-saturated gas leaves the vessel. The supply gas is provided to the bubbler at one end of the vessel and is allowed to bubble through the liquid solvent to become saturated with solvent. The gas is provided to one end of a jacketed vessel containing liquid solvent, is bubbled through the liquid solvent to saturate the gas with solvent, and then the solvent-saturated gas is transported from the vessel to the enclosure.

In an alternative embodiment, the saturation station includes first and second heat exchangers to vaporize the solvent and control the temperature of the saturated gas and to allow independent and metered control of both the solvent and inert gas streams. The first heat exchanger has a jacket which is heated. A supply is filled with solvent and solvent is metered from the supply to the bottom of the first heat exchanger. The solvent is vaporized in the first heat exchanger and is forced toward a second heat exchanger. Inert gas is added to the vaporized solvent at the inlet of the second heat exchanger and the gas and solvent are mixed to create solvent-saturated gas at the coater temperature. The second heat exchanger tempers the mix to the coater temperature. This mixture is transported from the second heat exchanger to the enclosure.

DETAILED DESCRIPTION

In developing the die enclosure of the present invention, a complete gas-filled enclosure of the entire coater module has been attempted. A total module enclosure contains a very large volume of gas which requires oxygen sensors, purge cycling to control the oxygen concentration, solvent concentration detectors, and a system for injecting make-up solvent gas to the enclosure. Because of the purge cycles, it is difficult to control the concentration at the limit of saturation of solvent in the atmosphere.

The coater die enclosure of the present invention is much simpler than a total module enclosure because it requires no complex control mechanism. The solvent-laden gas continuously purges the small enclosure volume. A flowmeter for the gas is the only required element for controlling the system. Because the volume is small and the gas is non-reactive, no expensive, complex sensors or controls are needed. This die enclosure provides easy access to the coater die and bead by simply opening a door to the enclosed area, even while coating. A total module enclosure provides no such accessibility. Also, this enclosure is compact, not much larger than, and in some cases smaller than, the die itself; a total module enclosure is much larger and cumbersome to set up.

Additionally, this coater die enclosure is superior to systems such as that of the '349 patent because solvent-saturated gas is actively supplied to the enclosure, thus eliminating the drying, not just retarding it. Because the die enclosure of the present invention completely surrounds the die, the bottom (upstream) lip also is protected from drying. The vacuum chamber on the upstream side of the die will continuously pull the solvent-laden gas, instead of the dry air from the coater room, into its cavity. Moreover, because the die enclosure system of this invention continuously purges the coater bead area with the solvent-saturated gas, interruptions in the coating are not a problem. The method of the '349 patent will not be effective if the coating is interrupted. These interruptions are common in a plant and tend to generate the most streak-causing drying.

Figure 1:
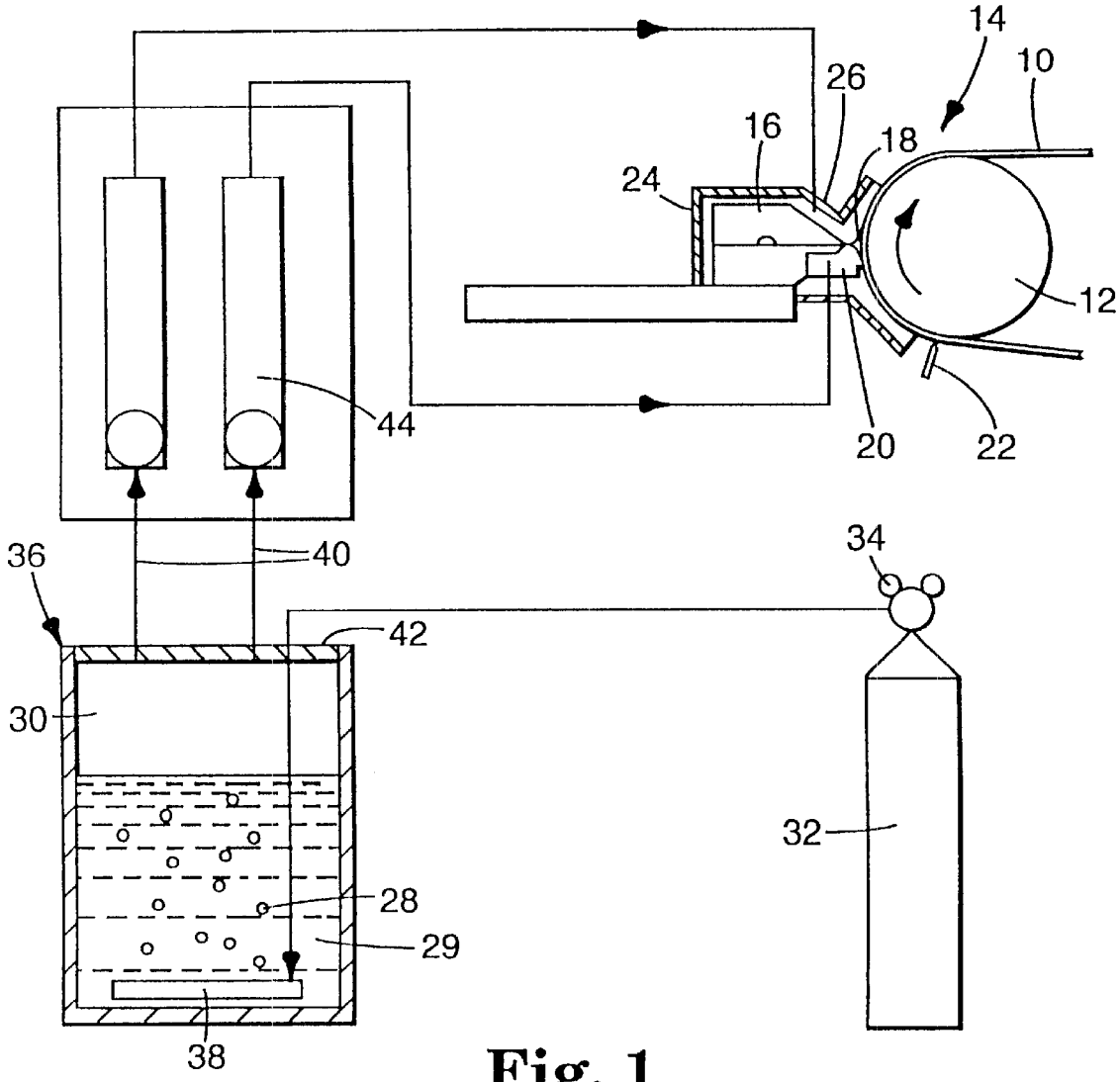
FIG. 1 is a schematic view of the die enclosure apparatus of the present invention.

FIG. 1 shows a die coating apparatus. The apparatus includes a substrate, such as a web 10, which is transported around a backup roller 12 or other support through a coating station 14. A coating die 16 is located adjacent the backup roller 12 to apply a coating fluid 18 onto the web 10 as the web passes the die. A vacuum chamber 20 is located adjacent the die 16 on the upstream side of the die to stabilize the coating bead. A knife 22 is located adjacent the web 10 further upstream than the vacuum chamber 20.

The enclosure system includes a die enclosure 24 and a device which supplies solvent-saturated gas to continuously purge the enclosure. The enclosure 24 has a retractable or sliding door 26 which provides easy access to the coater die 16 in the die lip/bead region. A window can be provided to allow viewing of the coating flow. The whole enclosure assembly is coated with a low-surface energy solvent resistant coating for easy clean-up. In the embodiment of FIG. 1, the die enclosure 24 completely surrounds the coater die 16 and the vacuum chamber 20 with a 0.3–1.2 cm (0.25–0.5 in) gap between the enclosure 24 and the back-up roller 12, although other opening sizes can be used. Both coater lips on either side of the bead are protected from drying of the coating fluid.

Although an extrusion coater is shown, this system can be used with any die coating method, such as slide and curtain coating. The enclosure also can be used with any flow bar for roll, gravure, kiss, or similar coating methods.

The gas 28 to be saturated with solvent gas 29 should be inert and non-reactive to prevent any possible explosion hazard, and can be nitrogen, argon, or carbon dioxide. If the solvent is water, the gas could be air. The solvent-saturated gas 30 is continuously pumped into the enclosure 24 at a regulated pressure, in an adequate volume, and at a low rate to maintain solvent saturation in the vicinity of the bead, to maintain a constant positive flow out of the enclosure, and to ensure that the atmosphere in the vicinity of the coater bead is always saturated with solvent. If too much gas 30 is supplied, currents in the gas could disturb the coating and excess solvent could be dumped in the coater room. If too little gas is supplied, some fluid drying can occur. The mass transfer of solvent from a liquid surface to the gas phase is proportional to the difference between the solvent gas concentration at equilibrium with the liquid and the bulk solvent gas concentration in the gas. Because the gas 30 supplied to the die enclosure 24 is already saturated with the solvent, no drying of the coating fluid is possible and no streaks can form due to coating fluid drying on the die lip. Because the gas flow is continuous, the door 26 can be opened at any time during coating. The gas can be supplied from a tank 32 through a regulator 34 as shown, but the gas could be supplied in other known manners such as conventional membrane separator technology for nitrogen or combustion for carbon dioxide.

A saturation station saturates the supply gas 28 with solvent gas 29. The solvent 29 can be a cosolvent mixture in equilibrium with the coating fluid. Saturation can be accomplished by any appropriate device such as a packed column, a wick, a jacketed vessel, or a heat exchanger combination as described below. As shown in FIG. 1, the saturation station is a jacketed vessel 36 containing the liquid solvent 29 with a porous metal bubbler 38. The supply gas 28 is provided to the bubbler 38 at the bottom of the vessel 36 and is allowed to bubble up through the liquid 29, thus becoming saturated with solvent. The vessel 36 is jacketed to allow control of the solvent temperature and compensate for evaporative cooling of the solvent. Generally, the solvent temperature should be at or near room temperature because if it is too low, the gas will not be completely saturated and if it is too high, solvent will condense in the line and enclosure downstream. The saturated gas 30 leaves the jacketed vessel 36 through tubes 40 in the lid 42. Two tubes 40 are shown although more or fewer tubes can be used to transport the solvent-saturated gas 30 from the saturation station to different ports on the die enclosure.

Flowmeters 44 regulate the flow of the solvent-saturated gas 30 to various parts of the die enclosure 24. If the flowmeters 44 are placed downstream of the saturation station, they should be constructed of materials to withstand the solvent gas. If individual control to locations in the enclosure 24 is deemed unnecessary, the flowmeter 44 could simply be a rotometer placed upstream of the saturation station. The meter parts can be glass and metal with KAL-REZ™ (E. I. du Pont de Nemours & Co.) seals. Because the smallest division of the flowmeters used is 1 CFM, the minimum overall flow is limited to 6 CFM (1 CFM times 6 flowmeters) where 6 flowmeters are used. Only two flowmeters are shown. Different meter arrangements can allow lower controlled flows.

Figure 2:
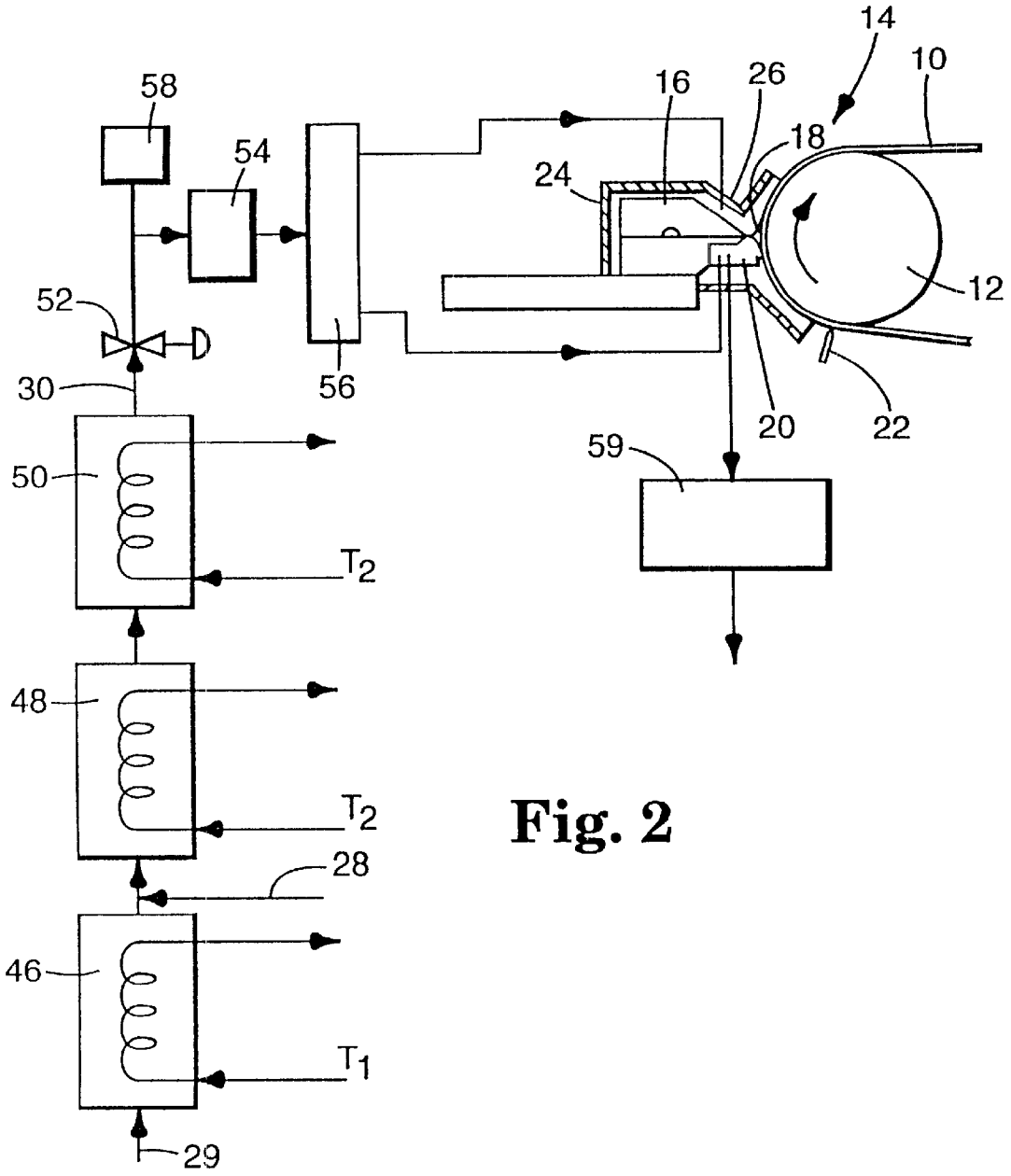
FIG. 2 is a schematic view of the heat exchanger system.

A second version of the saturation station is shown in FIG. 2. This system uses three heat exchangers 46, 48, 50, such as ITT 5-160-02-008-002 (P/N) heat exchangers, to vaporize the solvent 29 and control the temperature of the saturated gas 30. This design has several advantages over the jacketed vessel 36. First, heat transfer is much more efficient because of the larger surface area and smaller volume of solvent in the vaporization system. Heat transfer from the jacketed walls of a vessel is not as efficient because the jacket must be run warmer than room temperature at steady state operation which leads to oversaturation at start-up. Second, this system allows independent and metered control of both the solvent and inert gas streams. Pure solvent 29 is metered directly from a supply (not shown) to the bottom of the first heat exchanger 46 by a pump (not shown), such as a Zenith gear pump (2.92 cc/rev). The jacket of the first heat exchanger 46 is heated by a circulator unit (not shown) to a temperature $T_1$ that is greater than the boiling point of the solvent. When the solvent is THF which boils at 65.9° C. (150.7° F.), the jacket temperature is set at 79.4° C. (175° F.). The solvent vaporizes in this first exchanger 46 and rises toward the second exchanger 48. At the inlet of the second exchanger 48, the pure inert gas 28 is added to and mixed with the stream of THF vapor 29. The second and third exchangers 48, 50 are controlled at a temperature $T_2$, which is room temperature, 21° C. (70° F.) because the THF vapor from the first exchanger is too hot while the gas supply is probably cooler. Two exchangers are used to ensure that the gas supplied to the enclosure is at room temperature. Alternatively, the second and third heat exchangers can be combined in a single heat exchanger which reduce the solvent gas temperature. These exchangers should not be set lower than room temperature because the solvent would condense out of the gas phase inside of the exchangers leaving the gas unsaturated with solvent. The THF/gas mix leaves the third exchanger 50 and passes through a metering valve 52, a flowmeter 54 and a manifold 56, which splits the flow to the flowmeters to control the flow to the die enclosure. A dewpoint sensor 58 monitors the flow to the flowmeter 54 and a thermometer (not shown) in the manifold monitors the outlet gas temperature. The solvent leaves the vacuum chamber through vacuum lines, through a flow meter 59, and to a vacuum source such as a pump (not shown).

With this heat exchanger method, it is important to know exactly how much solvent to supply to the system for a given gas flow. This is accomplished using a mass balance based on the partial pressure of the solvent at room temperature. The governing formula is:

$$\frac{(\text{rev/min})}{(CFM_{saturated\ gas})} = \frac{(P_{solvent})(MW_{solvent})}{(R)(T_{absolute})(P_{liquid\ solvent})(pump\ \text{cc/rev})}$$

where, for THF at 295° K.:

$P_{THF}=1.8726\times10^4$ Pa $MW_{THF}=72.107$ g/mole $R=879.97$ kg/m$^3$ (pump cc/rev)=2.92 cc/rev 1 CFM=0.283 m$^3$/min For this system, 6.067 pump rpm are required per CFM of saturated gas. For 6 CFM of gas, this translates into about 106 cc of THF liquid per minute.

Another advantage of this type of system is that a saturated cosolvent system could be supplied to the enclosure when one solvent is not dominant. All that is required is another pump to supply the second solvent to the inlet of the first heat exchanger at a metered rate corresponding to its solvent gas pressure in equilibrium with the coating liquid. Alternatively, a single supply vessel and pump containing a cosolvent mix that, when vaporized, is in equilibrium with the coating liquid can be used.

Alternatively, the flow of the gas into the enclosure can be controlled automatically. A dewpoint (chilled mirror type) sensor can determine and control the saturation of solvent in the supply stream to the die enclosure. The flow rate can be controlled using flow meters instead of mechanical rotometers. This system has an almost immediate response time without any lag between start-up and steady state operation. Once the solvent mix is put into a solvent supply, the system automatically controls gas saturation with the dewpoint control and proper flow rates with the flow meters regardless of the vacuum and die setup. The only variable is the temperature to the first heat exchanger which is simply set higher than the boiling point of the highest boiling solvent.

If the inert gas is saturated with the solvent gas, then the dewpoint of the solvent gas in this stream is at room temperature, and measuring the dewpoint of the solvent gas directly measures the saturation, even for a cosolvent mix. The flow rate of the saturated gas stream is controlled with the knowledge of the amount of the gas flow withdrawn from the die enclosure by the vacuum chamber. Controlling the flow rate requires two flow meters. One is in the vacuum line to the vacuum source and the other is in the feed line to the die enclosures. The flow meter in the die enclosure feed line allows feedback control of a metering valve in that feed line.

The amount of gas supplied to the die enclosure should be greater than the amount withdrawn by a constant amount, and can be monitored using conventional flow sensors with low flow restrictions.

The set point for the dewpoint of the solvent gas would be the coater room temperature (such as 21° C.). The signal from the dewpoint sensor is used to control the amount of liquid solvent pumped by the metering pump to the high temperature heat exchanger for evaporation. The control is more stable if the dewpoint sensor controls the ratio of the pump speed to the gas flow rate to the die enclosure (rather than direct feedback control of the pump speed) because the ratio governs the saturation and the flow rate could deviate in a short time while the coater die gap and vacuum are adjusted as well as while the die is withdrawn from the backup roll.

A knife or blade 22, as shown in FIG. 1, can be provided on the upstream side of the enclosure to strip the air boundary layer from the incoming web. This reduces the amount of invading air and thus reduces the amount of solvent-laden gas that must be supplied to the enclosure.

Figure 3:
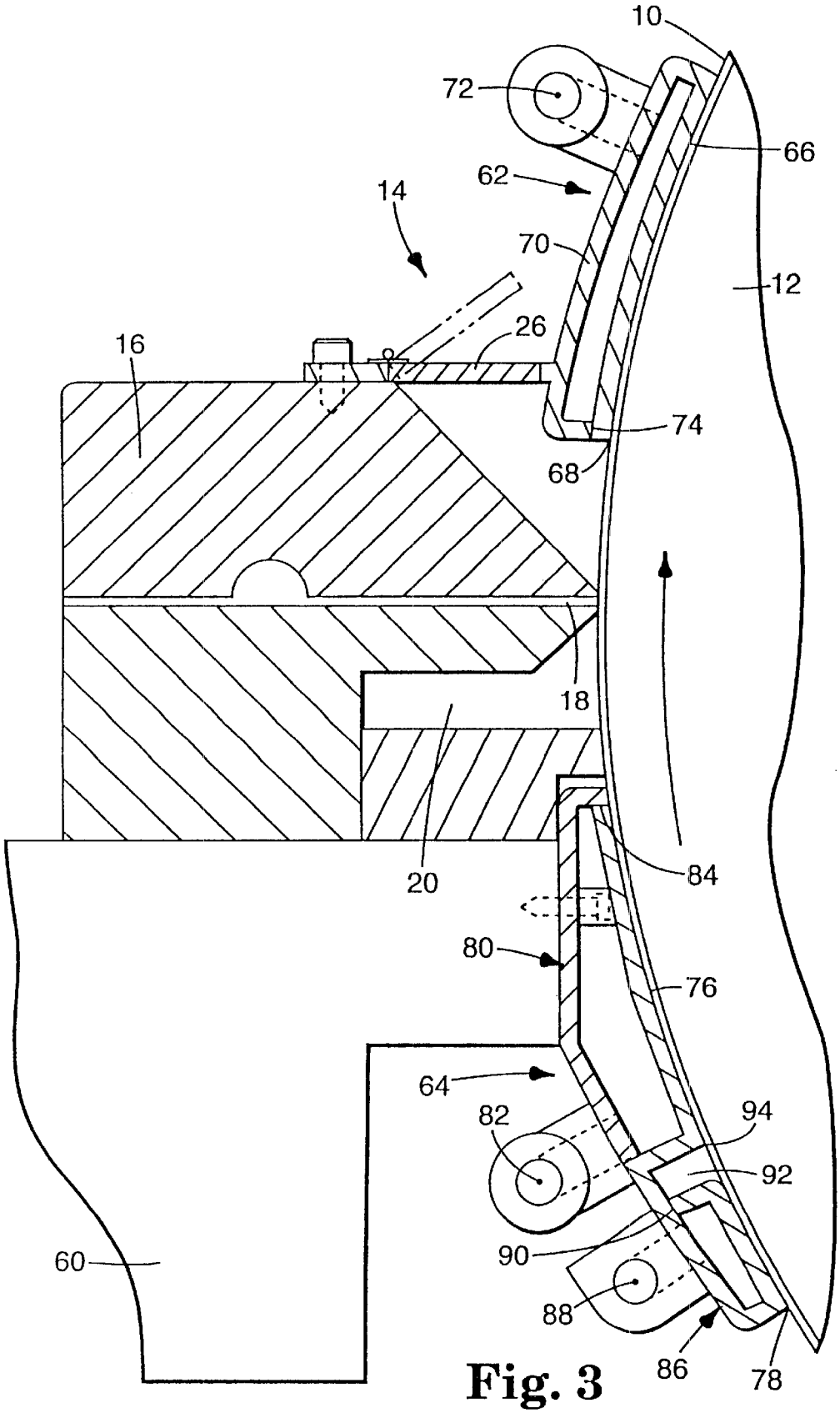
FIG. 3 is a cross-sectional view of the enclosure apparatus according to another embodiment of the present invention.

FIG. 3 shows another embodiment of the die enclosure in which only the die lips and vacuum chamber are enclosed. The die 16 applies a coating fluid 18 onto a web 10 passing around a backup roller 12. A vacuum chamber 20 is mounted to the die 16 at the upweb end of the die. The die 16 and vacuum chamber 20 are mounted on a die support 60. The die enclosure is formed of two components. An upper enclosure 62 seals between the downweb side of the die 16 and the backup roller 12, and a lower enclosure 64 seals among the upweb side of the die 16, the vacuum chamber 20, and the backup roller 12. End plates (not shown) seal the sides of the die 16 and the enclosures 62, 64. A single end plate can be used to seal an entire side of the die, the vacuum chamber and the enclosure.

The upper enclosure 62 is bolted to the die 16 and extends to the backup roller 12. The upper enclosure 62 has a relatively long intimate land seal 66 which resides at a gap of about 0.051 cm (0.020 inch) with the backup roller 12 and has a knife edge 68 at its upweb side. The long lands 66 provide a tight seal for the enclosure 62 and reduce the required amount of gas 30 required for the enclosure. The upper enclosure 62 forms a pressure distribution manifold 70 which is in fluid connection which an injection port 72 which feeds solvent-laden gas 30 through the manifold 70 and out of a continuous feed slot 74 into the upper enclosed area. The cross-sectional area of the gas feed slot 74 is less than that of the manifold 70 to allow balanced feed distribution. The solvent-laden gas 30 is injected uniformly crossweb. The pressure distribution manifold 70, improves the pressure distribution across the continuous feed slot 74.

The lower enclosure 64 is bolted to the die support 60 and extends to the backup roller 12. The lower enclosure 64 also has a relatively long intimate land seal 76 which resides at close proximity (about 20 mil) to the backup roller 12 and has a knife edge 78 at its upweb side. The knife edge 78 breaks up and strips the boundary layer of incoming air which otherwise attempts to enter the enclosed area with the web 10. The lower enclosure also forms a first pressure distribution manifold 80 which is in fluid connection which an injection port 82 which feeds solvent-laden gas 30 through the manifold and out of a continuous feed slot 84 into the lower enclosed area.

Additionally, the lower enclosure 64 can form a second pressure distribution manifold 86, upweb from the first pressure distribution manifold 80, which is in fluid connection which an injection port 88 which feeds solvent-laden gas 30 through the manifold 86 and out of a continuous feed slot 90 into a diffusion zone 92, which can include an expansion seal. A second knife edge 94 also is formed. The diffusion zone 92 serves to further reduce the possibility of air entering the enclosed areas. Alternatively, the second pressure distribution manifold 86 can feed a diluent gas, such as nitrogen, into the diffusion zone 92 to help reduce air and oxygen contamination by providing a barrier.

Due to the improved sealing provided by this embodiment, the gas consumption required is reduced to nearly the volume of gas withdrawn by the vacuum chamber 20. For a die 20.3 cm wide, the gas 30 could have a flow rate that is less than 0.0142 m3/min (0.5 CFM) more than the flow rate from the vacuum chamber.

Various changes and modifications can be made in the invention without departing from the scope or spirit of the invention. For example, although the embodiments are illustrated using a die as the coating applicator portion of the coater apparatus, other coating apparatus can be used. Also, additional features can be added such as a valve, with sensors and controllers, to prevent air from entering the system when the enclosure does not seal to the backup roller. Solvent supply level indicators and alarms, flow and pressure sensors, and various valves also can be used to prevent problems from occurring when coating stops.

What is claimed is:

1. A method of preventing coating material from drying on a coating applicator portion of a die coating, roll coating, gravure coating or kiss coating apparatus comprising:

enclosing at least part of a die coating, roll coating, gravure coating or kiss coating apparatus with an enclosure;

saturating a non-reactive gas with a solvent;

circulating the solvent-saturated gas through the enclosure to prevent coating material from drying on a coating applicator portion of the die coating, roll coating, gravure coating or kiss coating apparatus while the coating material is being applied to a substrate wherein, during the circulating step, there is a constant positive flow of the solvent-saturated gas out of the enclosure.

2. The method of claim 1 wherein the saturating step comprises:

providing the gas to one end of a jacketed vessel containing liquid solvent;

bubbling the gas through the liquid solvent to saturate the gas with solvent; and transporting the solvent-saturated gas from the vessel to the enclosure.

3. The method of claim 1 wherein the saturating step comprises:

metering solvent from a supply to the bottom of a first heat exchanger;

vaporizing the solvent in the first heat exchanger to cause the solvent to rise toward a second heat exchanger;

adding gas to the vaporized solvent at the inlet of the second heat exchanger;

mixing the gas and solvent to create solvent-saturated gas;

transporting the solvent-saturated gas from the second heat exchanger to the enclosure.

4. The method of claim 1 wherein the circulating step comprises continuous circulation of the solvent-saturated gas.

5. The method of claim 1 wherein solvent saturation is maintained at the coating applicator portion.

6. The method of claim 1 wherein the solvent comprises a cosolvent mixture in equilibrium with the coating material.

* * * * *